US006408440B1

(12) United States Patent
Phillips

(10) Patent No.: US 6,408,440 B1
(45) Date of Patent: Jun. 25, 2002

(54) PROTECTIVE VEST

(76) Inventor: Richard S. Phillips, 451 Constellation, No. 1309, League City, TX (US) 77573

( * ) Notice: Subject to any disclaimer, the term of this patent is extended or adjusted under 35 U.S.C. 154(b) by 0 days.

(21) Appl. No.: 09/577,452

(22) Filed: May 24, 2000

(51) Int. Cl.[7] ..... A41D 13/00
(52) U.S. Cl. ..... 2/102; 2/456
(58) Field of Search ..... 2/463–465, 455, 2/456, 102, 69, 108, 94, 462, 2.5; 89/36.01, 36.02, 36.05; 428/911

(56) References Cited

U.S. PATENT DOCUMENTS 4,181,993 A * 1/1980 McDaniel ..... 9/329
5,316,820 A * 5/1994 Harpell et al. ..... 428/109
5,317,950 A * 6/1994 Binon et al. ..... 89/36.02
5,465,424 A * 11/1995 Cudney ..... 2/456
5,524,641 A * 6/1996 Battaglia ..... 128/846
5,530,966 A * 7/1996 West ..... 2/456
5,675,844 A * 10/1997 Guyton et al. ..... 2/455
5,996,115 A * 12/1999 Mazelsky ..... 2/2.5

* cited by examiner

*Primary Examiner*—Gloria M. Hale
*Assistant Examiner*—Tejash Patel
(74) *Attorney, Agent, or Firm*—John R Casperson

(57) ABSTRACT

A laminate of thermoplastic over foam is well suited for making plates to be used in a protective paint-ball vest. The vest is constructed of many such plates mounted to fabric to provide good ventilation and freedom of movement with adequate protection levels against commonly encountered hazards. The vest can be made reversible to facilitate team games and is highly suitable for use in paint ball games.

14 Claims, 3 Drawing Sheets

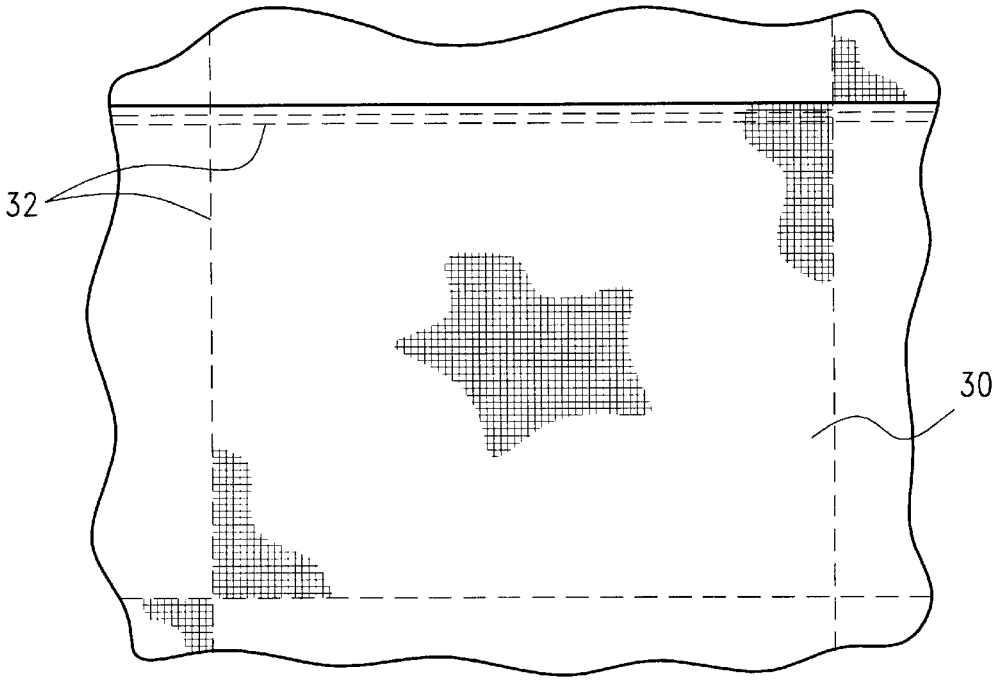
FIG.4
FIG.5
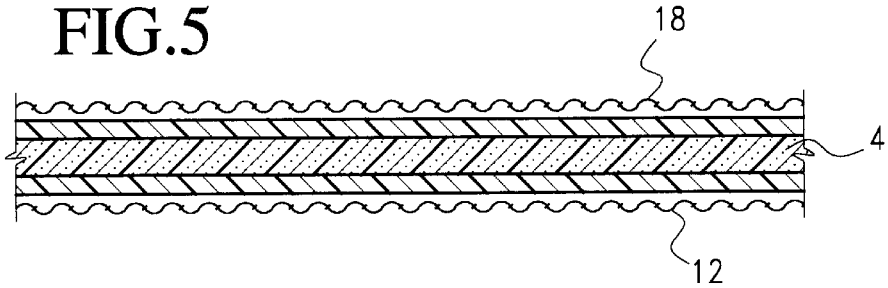
FIG.6
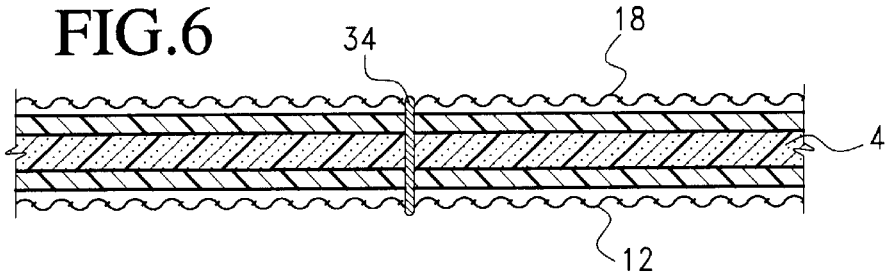

PROTECTIVE VEST

BACKGROUND OF THE INVENTION

In one aspect, this invention relates to a plate or panel formed from polymeric composite material. In another aspect, this invention relates to a protective body garment, such as a vest, which is formed from such composite material.

Paint ball guns fire a paint filled gelatin encapsulated projectile which weighs approximately 50 grains (about 3.2 grams) at a velocity of about 300 feet per second (9150 cm/sec). The kinetic energy of the projectile is given by the formula $$e=\frac{1}{2}mv^2,$$

which, in the just given example, is about 134 ($10^6$) ergs, or about 10 foot pounds, which is an energy level approximately the same as that developed by a small game air gun firing a lead pellet. Being shot at close range with a paint ball gun causes bruising and hurts.

Participants in paint ball games therefore generally wear protective gear, including goggles and heavy clothing. However, the heavy clothing does not absorb the paint ball energy very well and is very uncomfortable for summer use, or for use when the participant is vigorously active in the game. Lightweight protective body armor that is effective for absorbing the energy from the projectiles and is well ventilated for comfortable summertime or high activity level use would be very desirable.

Another problem encountered in paint ball games is that the participants sometimes form teams, but because of the protective gear it is sometimes difficult to quickly determine a player's allegiance. Protective gear which has capability of being easily converted to displaying a team color which can be quickly differentiated from that of another team would be very desirable.

Participants in other sports also have need for protective gear. For example, participants in martial arts such as karate could benefit from a protective vest which provides good impact protection. Soccer players, hockey players, skaters, skate boarders, and motor cross participants, to name but a few, also are at risk of injury to the torso area and have need for a lightweight protective vest.

OBJECTS OF THE INVENTION

It is an object of this invention to provide a lightweight armor plate which is effective to prevent bruising or other tissue damage from impacts such as might be generated by paint balls.

It is another object of this invention to provide a protective garment for sports participants, such as paint ball game participants, which contains such plates.

It is another object of this invention to provide a protective garment for sports participants, such as paint ball game participants, which is well ventilated.

It is a further object of this invention to provide such a protective garment which can be easily converted in color, to facilitate team play in games such as paint ball games.

SUMMARY OF THE INVENTION

One embodiment of invention provides a laminate especially well suited for sports body armor. The laminates comprise a sandwich structure of polymer foam between tough plastic sheets. The polymer foam is in the form of a sheet of dimensionally stable structural polymer foam and has a first face and a second face. A first tough plastic sheet is adhered to the first face of the sheet of structural foam, and a second tough plastic sheet is adhered to the second face of the sheet of structural polymer foam. The structure is especially well suited for absorbing and spreading the impact from a projectile having a velocity up to at least about 330 fps (100 m/s), as well as providing protection from fists, feet or clubs traveling at lower velocities.

The above described laminate is well suited for use in the construction of user-protective garments, especially for paint ball game use. A particularly preferred garment is a protective vest for a user which comprises a fabric backer configured to cover the user's torso and a plurality of protective plates fastened to the fabric backer so as to substantially cover the fabric backer. The protective plates each comprise a dimensionally stable structural polymer foam layer sandwiched between two layers of tough plastic film. The plates absorb paint ball or other impacts while the fabric can be colored to identify the user's team and permits ventilation from underneath the plates to the outside of the garment.

BRIEF DESCRIPTION OF THE DRAWINGS

FIG. 4 is a close up view illustrating one method of fastening a plate to garment fabric according to one embodiment of the invention.

FIG. 5 is a cross sectional view showing garment construction details according to one embodiment of the invention.

FIG. 6 is a cross sectional view showing garment construction details according to another embodiment of the invention.

DETAILED DESCRIPTION OF THE INVENTION

Figure 1:
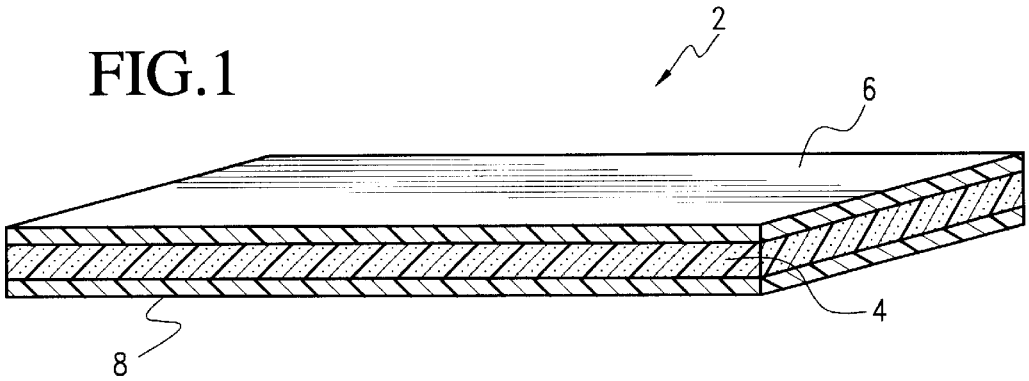
FIG. 1 is a pictorial representation of a plate according to one embodiment of the invention.

With reference to FIG. 1, a laminate 2 comprises a sandwich structure of polymer foam 4 between tough plastic sheets. The polymer foam is in the form of a sheet of dimensionally stable structural polymer foam and has a first face and a second face. A first tough plastic sheet 6 is adhered to the first face of the sheet of structural foam, and a second sheet 8 of a tough plastic adhered to the second face of the sheet of structural polymer foam. The structure illustrated is especially well suited for absorbing and spreading the impact from small projectiles having a velocity up to at least about 330 fps (100 m/s), and also provides protection from impacts by more massive objects at lesser velocities.

For paint ball use, it is preferable that the laminate be relatively thin. Generally, speaking, the laminate has a thickness as measured between the outer surface of the first tough plastic sheet and an outer surface of the second tough plastic sheet which is less than ½ inch (about 1.25 cm). For vest construction (see FIGS. 2 and 3) generally polygonal such as rectangular plates having an area between about 5 square inches and about 50 square inches (32 to 320 $cm^2$) are highly suitable. Other shapes, preferably polygonal, such as triangular or hexagonal, can be used if desired. When preferred materials are used, a thickness in the range of about 0.2 to about 1 cm, and rectangular plates having an area between about 10 square inches and 40 square inches (65 to 260 $cm^2$) will provide good results. In an exemplary embodiment, a 5×6×¼ inch (12.7×15.2×0.7 cm) plate constructed according to a preferred embodiment of the invention had a weight of about 1 oz. (28 g) and was furthermore flexible, with some capability to conform to a user's movements and body shape.

A wide range of foam materials are believed suitable. Preferably, the foam has good rebound characteristics—so that it is not easily damaged during use. A closed-cell polyolefin foam having a density in the range of about 0.01 to 0.1 grams per cubic centimeter is generally preferred. A cross-linked polyethylene foam having a density in the range of about 0.02 to 0.07 grams per cubic centimeter and a thickness in the range of 0.4 to about 0.8 cm is most preferred because it has been tested with good results.

The tough plastic sheets are preferably films having a thickness in the range of 0.005 to 0.050 inches (0.01 to 0.13 cm) which have been laminated to the dimensionally stable structural foam. A film having a thickness in the range of 0.02 to 0.04 inches (0.05 to 0.1 cm) has been tested with good results and is preferred. Preferred films are generally thermoplastic films because these materials generally possess the requisite toughness to resist damage during ordinary conditions of use and are cost effective. Of the thermoplastic films, a polycarbonate is preferred since a polycarbonate graphic thermoplastic film was tested with good results. A wide variety of techniques can be used to adhere the polycarbonate film to the foam substrate with good results. A technique which is particularly preferred since it has been tested with good results is to employ a double backed adhesive tape.

Figure 7:
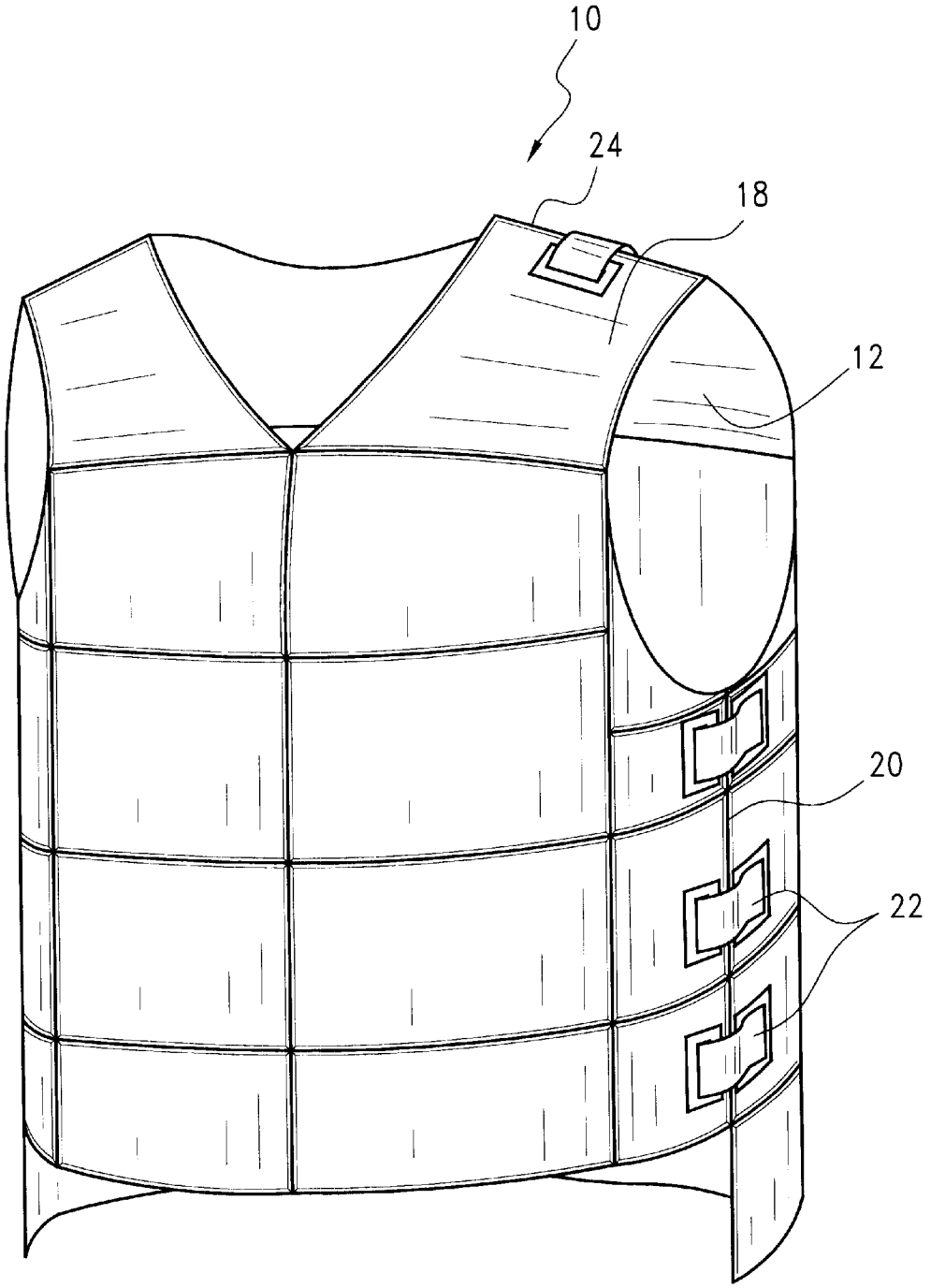
FIG. 7 is a pictorial representation of a protective vest made according to an embodiment of the invention.

A protective garment 10 (see FIG. 7) especially well suited for use as paint ball armor comprises a fabric backer 12 configured to cover the user's torso and a plurality of the protective plates 2 fastened to the fabric backer so as to substantially cover the fabric backer. The protective plates can be as described previously and generally speaking will comprise a dimensionally stable structural polymer foam layer sandwiched between two layers of tough plastic film.

Figure 2:
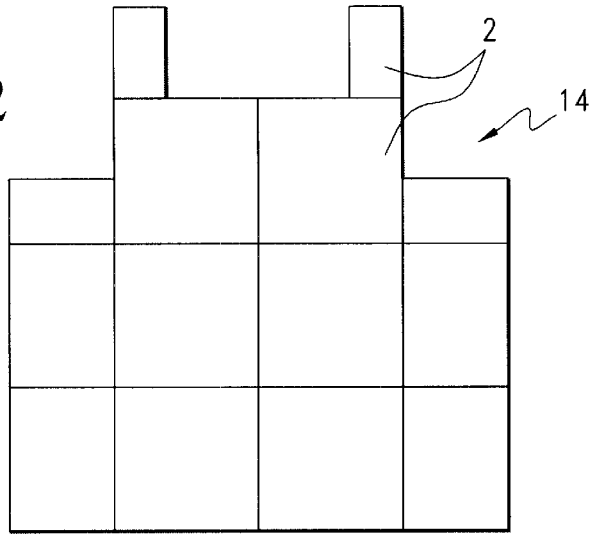
FIG. 2 is a schematic view of a plate layout in a vest front according to another embodiment of the invention.
Figure 3:
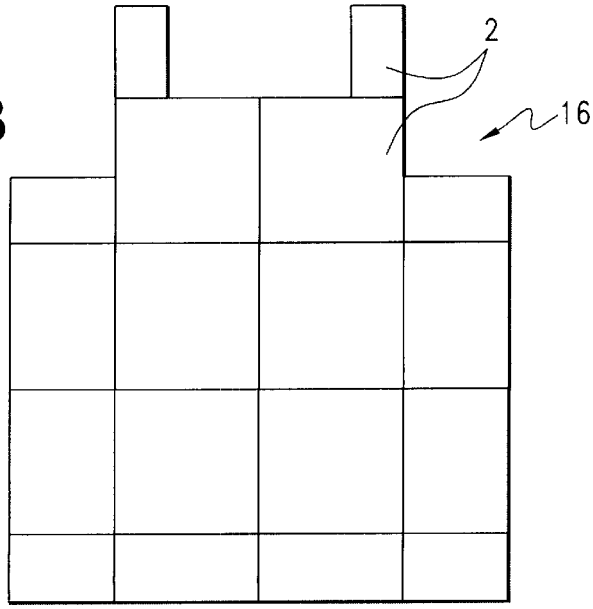
FIG. 3 is a schematic view of a plate layout in a vest back according to another embodiment of the invention.

The preferred vest constructed according to the invention will generally comprise a vest back and a vest front. FIG. 2 illustrates a desirable plate layout for a vest front 14. FIG. 3 illustrate a desirable plate layout for a vest back 16. The vest back is longer than the vest front to protect the user from behind, especially when crouching, and the shorter front makes it easier for the user to assume a crouch. The protective vest generally will employ in the range of 20 to 120 plates fastened to the fabric backer. The plates are preferably large enough so as not to imprint and leave a bruise on the user underneath when struck by a paint ball but need to be small enough so as not to impede the user's body movements to an undesirable extent and to better conform to the body shapes of different users, for example, male and female.

In a preferred embodiment, the protective vest comprises a fabric cover 18 substantially covering the plurality of plates and fastened to the plates. In order to facilitate putting the vest on, the vest preferably defines at least one closeable opening 20 extending from an upper portion of the vest to a lower portion of the vest and a plurality of fasteners 24 extending along the sides of the opening and attached to at least one of the fabric backer and the fabric cover to permit the user to don the vest and close the opening with the fasteners. In the illustrated embodiment, the opening is provided by a first closeable opening which extends from an armhole in the vest to a lower hem of the vest. A second closeable opening extends from a neckhole in the vest to the armhole. Other arrangements could be used if desired. The fasteners illustrated are of the hook and loop type, such as Velcro® brand fasteners, although other types of fasteners could be used if desired.

For paint ball use, it is preferred that the vest be reversible, to facilitate team play. The fabric backer 12 is preferably a first color or pattern and the fabric cover 18 is preferably a second color or pattern. For example, one side can be camouflage and the other side black. Or, one side can be green camouflage and the other side brown camouflage. The fasteners 22 are attached to the vest so that the vest can be worn to show either the first color or the second color, at the option of the user. The plates are well suited for use in a reversible vest. Although a wide variety of materials can be used to form the fabric backer and cover, canvass-like materials are preferred, especially those that are washable. For example Kevlar® brand fabric, which is a polyaramid, is suitable.

The plates can be fastened to the backer using a wide range of techniques. In the embodiment of the invention shown in FIG. 4, the fabric backer is stitched to the fabric cover between the plates along seams 32 so as to locate the plates in pockets 30 defined between the fabric backer and the fabric cover 20. The interstitial fabric between adjacent plates permits some ventilation of moisture laden air from underneath. Side panels constructed of a breathable and preferably stretchable material such as polyester can be used to join the front and back halves of the vest to provide additional ventilation if desired. Another technique to fasten the plates is to stitch the plates directly to the fabric backer and optional fabric cover as shown in FIG. 6. When employing this technique, stitch 34 should be loose so as to avoid collapsing the foam 4 and reducing the effectiveness of the vest. If desired, both techniques can be employed. The plates can be positioned in the pockets, urged together to narrow the interstitial openings, and sewn directly to the fabric to avoid drifting in the pockets and forming gaps between adjacent plates.

While certain preferred embodiments of the invention have been described herein, the invention is not to be construed as being so limited, except to the extent that such limitations are found in the claims.

What is claimed is:

1. A protective vest for a user comprising a fabric backer configured to cover the user's torso and a plurality of protective plates fastened to the fabric backer so as to cover said fabric backer, wherein the protective plates each comprise a dimensionally stable structural polymer foam layer sandwiched between two layers of tough plastic film.

2. A protective vest as in claim 1 wherein in the range of 20 to 120 plates are fastened to the fabric backer.

3. A protective vest as in claim 2 wherein the dimensionally stable structural polymer foam layer comprises a closed-cell polyolefin foam having a density in the range of about 0.01 to 0.1 grams per cubic centimeter and a thickness in the range of from about 0.2 to about 1 cm and the tough plastic films have a thickness in the range of 0.005 to 0.050 inches (0.01 to 0.13 cm).

4. A protective vest as in claim 3 further comprising a fabric cover substantially covering the plurality of plates and being fastened to said plates.

5. A protective vest as in claim 4 which defines at least one closeable opening extending from an upper portion of the vest to a lower portion of the vest and a plurality of fasteners extending along the sides of the opening and attached to at least one of the fabric backer and the fabric cover to permit a user to don the vest and close the opening with the fasteners.

6. A protective vest as in claim 5 wherein a first closeable opening extends from an armhole in the vest to a lower hem of the vest.

7. A protective vest as in claim 6 wherein a second closeable opening extends from a neckhole in the vest to the armhole.

8. A protective vest as in claim 5 wherein the fabric backer is a first color or pattern and the fabric cover is a second color or pattern and the fasteners are attached to the vest so that the vest can be worn to show either the first color or the second color, at the option of the user.

9. A protective vest as in claim 8 wherein the dimensionally stable structural polymer foam layer comprises a closed-cell polyolefin foam having a density in the range of about 0.02 to 0.07 grams per cubic centimeter and a thickness in the range of from about 0.4 to about 0.8 cm and the tough plastic films have a thickness in the range of 0.02 to 0.04 inches (0.05 to 0.1 cm).

10. A protective vest as in claim 9 wherein the fabric backer is stitched to the fabric cover between the plates so as to locate the plates in pockets defined between the fabric backer and the fabric cover.

11. A protective vest as in claim 10 wherein the foam comprises a cross-linked polyethylene foam and the film comprises a polycarbonate graphic thermoplastic film.

12. A protective vest as in claim 9 wherein the plates are stitched to the fabric backer.

13. A protective vest as in claim 8 wherein interstitial fabric between adjacent plates permits ventilation of moisture laden air.

14. A protective vest as in claim 8 wherein fabric panels connecting a front half of the vest to a back half of the vest permit the ventilation of moisture laden air.

* * * * *